US005295875A

United States Patent [19]

McCardell

[11] Patent Number: 5,295,875

[45] Date of Patent: Mar. 22, 1994

[54] MICROPIN CONNECTOR SYSTEM

[75] Inventor: Willard B. McCardell, Rochester, Mich.

[73] Assignee: Cardell Corporation, Rochester Hills, Mich.

[21] Appl. No.: 13,231

[22] Filed: Feb. 3, 1993

Related U.S. Application Data

[60] Continuation of Ser. No. 767,636, Sep. 30, 1991, abandoned, which is a division of Ser. No. 670,757, Mar. 15, 1991, Pat. No. 5,100,346.

[51] Int. Cl.[5] ..... H01R 13/11

[52] U.S. Cl. ..... 439/851; 439/856; 439/879

[58] Field of Search ..... 439/851, 852, 856, 857, 439/843, 866, 877, 899

[56] References Cited

U.S. PATENT DOCUMENTS

| | | | |
|---|---|---|---|
| 3,003,135 | 10/1961 | Purinton | 339/262 |
| 3,286,222 | 11/1966 | Drinkwater | 339/258 |
| 3,317,887 | 5/1967 | Henschen et al. | 339/256 |
| 3,763,458 | 10/1973 | Taormina et al. | 339/59 R |
| 4,033,663 | 7/1977 | McCardell | 339/128 |
| 4,085,989 | 4/1978 | McCardell | 339/59 M |
| 4,120,556 | 10/1978 | Waldron et al. | 339/142 |
| 4,184,736 | 1/1980 | Spaulding | 439/879 |
| 4,262,987 | 4/1981 | Gallusser et al. | 339/258 R |
| 4,272,150 | 6/1981 | Fairbairn | 439/879 |
| 4,278,317 | 7/1981 | Gallusser et al. | 339/258 R |
| 4,431,256 | 2/1984 | Piscitelli et al. | 339/258 R |
| 4,461,530 | 7/1984 | Brush, Sr. et al. | 339/258 R |
| 4,493,527 | 1/1985 | Piscitelli et al. | 339/258 R |
| 4,550,972 | 11/1985 | Romak | 439/851 |
| 4,685,761 | 8/1987 | Locati | 439/843 |
| 4,971,579 | 11/1990 | Mobley et al. | 439/595 |
| 4,973,268 | 11/1990 | Smith et al. | 439/595 |
| 4,986,758 | 1/1991 | Wakata | 439/595 |
| 5,067,916 | 11/1991 | Denlinger et al. | 439/857 |

*Primary Examiner*—Paula A. Bradley
*Attorney, Agent, or Firm*—Jones, Tullar & Cooper

[57] ABSTRACT

An electrical connector system includes socket and plug connector components which each receive a plurality of electrical wires for interconnection. The socket and plug components each include a molded receiver element having a plurality of elongated, parallel locking finger elements and a molded spacer element having a plurality of elongated, parallel spacer fingers. The receiver and spacer elements are assembled so that their respective fingers are interdigitated to define a plurality of terminal receiver channels within each of the socket and plug components. Each of the electrical wires carries a socket or a pin terminal for connection to respective socket or plug components, the terminals each incorporating a locking surface which engages a corresponding locking surface formed in corresponding terminal receiver channels, so that the terminals can be releasably secured in the connector components.

3 Claims, 7 Drawing Sheets

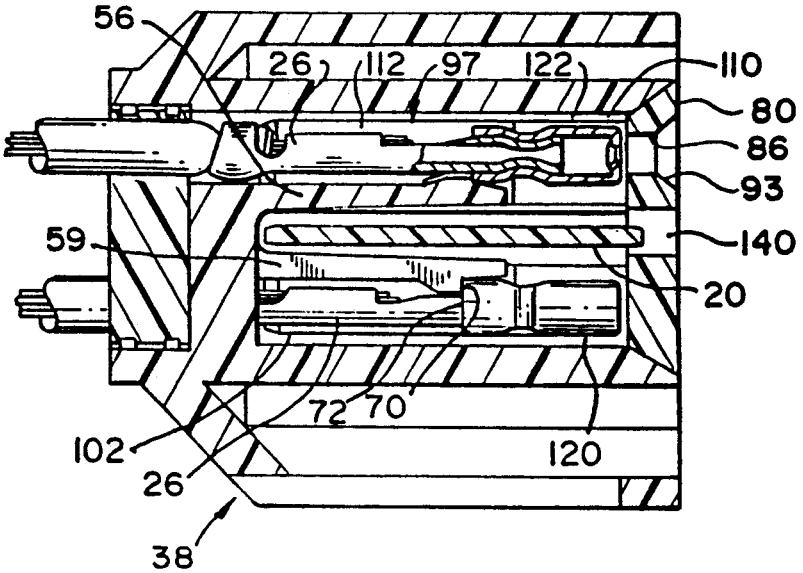
FIG. 4
FIG. 5
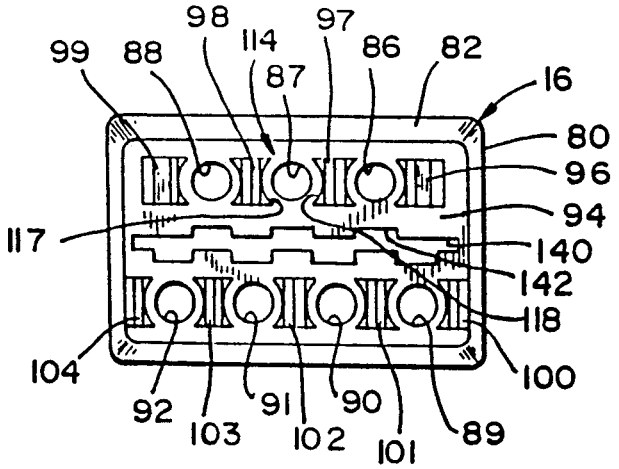
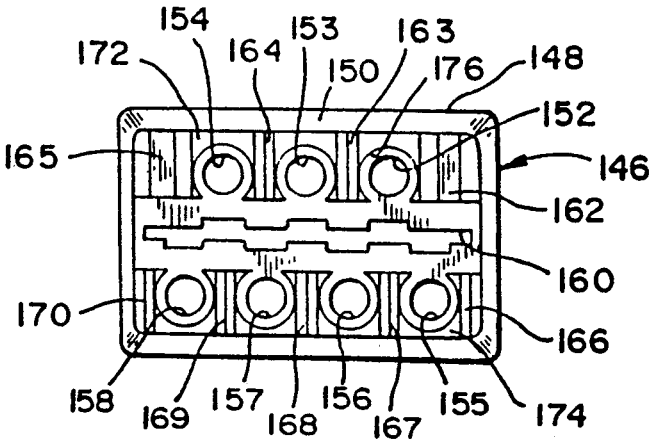
FIG. 6

MICROPIN CONNECTOR SYSTEM

This application is a continuation, of application Ser. No. 07/767,636, filed Sept. 30, 1991, now abandoned, which is a division of Ser. No. 07/670,757, filed March 15, 1991, now U.S. Pat. No. 5,100,346.

BACKGROUND OF THE INVENTION

The present invention relates, in general, to an improved electrical connector system, and more particularly, to a micropin system which incorporates a two-part connector housing including a plug component, and a socket component. Each component is adapted to receive corresponding pin terminals and receptacle terminals formed on the ends of interconnect wires and is shaped to facilitate the assembly of wire harnesses. The connector system provides plug and socket terminations at the ends of such harnesses for in line connections to corresponding terminations on other harnesses or for header connections to suitable electronic components such as microprocessor control elements, sensors and the like.

The rapid development of electronic systems for a wide range of industrial products and consumer goods has resulted in a heavy demand for improvements in the wire interconnects between electronic control components, the sensor elements connected to various parts of appliances, automobiles, and the like, and the various elements being controlled by such electronic components. These wired interconnects are often in the form of wire harnesses, wherein multiple wires are secured together to provide connections between specified locations and wherein the wires are provided with plug and socket terminations for interconnection with electronic components or other wire harnesses. A typical example of these harnesses and the corresponding lug and socket terminations is found in automotive applications, where increasing numbers of electronic sensors and control systems are being provided, requiring larger quantities of wire interconnects and increasingly complex wiring harnesses to provide the required connections to the various system elements.

The expanding use of wire harnesses and the increasing number of plug and socket terminations for such harnesses has highlighted the problems that have been encountered in prior interconnection systems, for as additional connectors are used, it becomes increasingly important to provide connectors which can easily be connected and disconnected and, even more importantly, can be automatically or manually assembled in harnesses accurately and easily so as to insure reliability while maintaining as low cost as possible. Generally, wiring harnesses utilizing multiple wires connected to the plug and socket components forming the harness terminations have been hand assembled, with individual wires being inserted into corresponding connector locations on both the plug and socket ends of the harness. The assemblers must select specific cables or wires for specific connections in the harness, and must secure them accurately and reliably to the corresponding plug and socket components. The plug and socket components must be constructed so that there is a positive lock for the individual wire terminals not only to retain the wires in place during the assembly process, but to enable the assembler to know that the wire is positively seated in its respective connector components. At the same time, the wires must be removable from the plug or the socket in case an error is made, so as to avoid the need to discard an entire harness if one wire is put in the wrong location. This requires a careful design of both the terminal on the end of the wire and the receiver in the plug or socket portion of the connector so that the wires can be easily handled without tangling and so that the terminals can be inserted into the connectors easily and accurately, while being removable in case errors are made, so as to insure proper positioning for reliable interconnection with electrical components or other wiring harnesses.

One solution to the foregoing problems found in the prior art was a locking wedge system, wherein a connector housing was provided with a plurality of flexible locking fingers which engaged detents or indentations formed in wire terminals positioned in the connector to secure the wire in place. The indentation on the terminal allowed the finger to engage and secure the wire while the flexibility of the finger permitted the wire to be removed without undue force. After assembly of the wires in the harness to the connector, a wedge was placed between adjacent fingers in the connector to prevent the fingers from flexing and to thereby securely lock them in contact with the wire terminals. This also assured the assembler that the terminals were fully in place, for if any one terminal was not fully inserted, the corresponding finger would be held out of position, and this would prevent the wedge from being inserted.

The locking wedges provided a satisfactory solution to the above-described problems as long as the overall size of the connectors was not a consideration. However, when the growth of electronic systems further increased the number of wires to be included in a harness, and the miniaturization of electronic components placed restrictions on the size of the connectors for these harnesses, problems arose with the locking wedge style of connector. The miniaturization of the harness terminations initially involved simple downsizing of the connectors, but it was soon found that the locking fingers became very fragile as they were made smaller, and the strength and reliability of the connectors suffered. Further, the fragility of the locking fingers made them susceptible to damage upon insertion of a locking wedge if one of the wires was not fully inserted in the connector.

As more wires were included in a harness and as the connectors were made smaller, the wires were forced into close proximity, not only making the assembly of a harness more difficult, but also causing significant problems in the manufacture of the connector itself. The downsizing of the connector imposed increasingly high standards for manufacturing tolerances, both for the connector housing portions and for the wire terminals. For example, by increasing the number of wires and often at the same time requiring smaller connectors, the spacing between the wires within the connector of necessity became smaller. As a result, the isolating walls between adjacent wire terminals had to be made thinner, but more importantly, in order to maintain the spacing between such isolating walls and the flexible fingers required by the molds used to make the connectors, the fingers had to be made smaller. The small connector dimensions created serious manufacturing problems, since the connector housings typically are molded from plastic materials, and the tools and dies used to form the connector parts are extremely complex. As the sizes and tolerances became smaller, the difficulty, and expense, of making the molds and maintaining them became excessive. In addition, the need to insert locking wedges into these smaller connectors in order to secure the locking fingers, and thus hold the assembled wire terminals in place without damaging the fingers made automated assembly of the harnesses very complex, and thus unsatisfactory. Yet the demand for smaller connectors with larger numbers of terminals continued, and the demand is still increasing for reductions in connector size, as well as reductions in the cost of manufacturing connector housings and wiring harnesses.

The wire terminals utilized on the individual wires used in such harnesses typically have been shaped from sheet metal through a series of precision forming steps which shaped the terminal to form either a pin (male) or a receptacle (female), these terminals being shaped to fit into corresponding connector housing lug and socket portions, respectively, for retention therein by the locking fingers and wedges described above. However, as the connectors have become miniaturized, it has been necessary to also miniaturize the wire terminals, and serious problems have been encountered in meeting the miniaturization requirements. It has been found, for example, that as the pins and receptacles are made smaller, it becomes extremely difficult to maintain proper tolerances that will insure reliable electrical contact when the connectors are mated with each other or with electrical components, or to maintain assembly forces within desired ranges. Thus, if the pin portion is too large for the receptacle portion, assembly becomes very difficult; on the other hand, if the pin is too small, then electrical contact is not reliably made. Furthermore, the precision forming steps required to make such terminals caused metal stress and fatigue which often resulted in broken terminals and resultant failure of electrical connections and produced a seam on the mating surfaces which increased assembly forces and reduced electrical contact. the precision forming of the terminals also resulted in significant scrap metal loss and rounded corners which prevented positive locking action. Further, the size and shape of such terminals required excessive motion of the locking fingers in the connectors, requiring additional space and preventing downsizing.

Thus, there has been a demand for reductions in the size of electrical connectors and/or an increase in the number of wires carried by such connectors. Further, there is a need for such connectors which can be accurately and reliably assembled, either manually or through the use of automatic machinery. When automatic machinery is used, it is desirable to avoid the necessity of inserting locking wedges, since this adds another complex step to the assembly process; however, when the harnesses are manually assembled, the use of a wedge may be desirable to insure complete insertion of all of the terminals. Thus, there is a need for a small, compact harness connector which provides positive locking for terminals when the harness is assembled by machine, so that locking wedges are not required to hold the terminals in place during use of the connector, yet which has provision for a locking wedge to insure complete insertion of the terminals when the harness is manually assembled.

SUMMARY OF THE INVENTION

It is, therefore, an object of the present invention to produce a connector system utilizing improved wire terminals and connector housings which will overcome problems encountered in the prior art, some of which are enumerated above, and which will thereby enable the manufacture of smaller, more reliable connectors at a reduced manufacturing cost.

It is a further object of the invention to provide a microminiature connector housing including plug and socket housing components for receiving corresponding wire terminals, for releasable securing the terminals positively and reliably in corresponding locations in the connector housing, and for providing reliable interconnections between the connector components when used in inline applications or between a connector and a header connection to electronic components, while reducing the size of the connector.

It is another object of the invention to provide an electrical connector construction which accomplishes miniaturization of the connector housing and the terminals which the connector receives without compromising the strength of the connector and without adversely affecting the electrical isolation of adjacent terminals, while retaining the benefits of larger terminals for ease of assembly, security and reliability, as well as ease of interconnection.

It is a further object of this invention to provide a connector for multiple wire terminals which is adapted for either automated machine assembly or for manual assembly.

It is a still further object of the invention to provide a miniaturized electrical connector for receiving and holding multiple terminals securely without the need for a locking wedge so as to permit automated assembly, but which will accommodate such a wedge to permit reliable manual assembly of multi-wire harnesses.

Briefly, the present invention includes a microminiature connector housing which includes plug and socket connector components, with each component being formed from two interlocking parts which are separately molded to facilitate the manufacturing process and to meet tolerances which can easily be attained by conventional molding techniques, and which, when assembled, provide the close spacing of adjacent parts which could not be attained, because of mold restrictions, if the connector components were manufactured as single unitary parts. In the preferred form of the invention, each connector housing component includes a receiver element and a spacer element, the receiver element including apertures for receiving corresponding wire terminals, and including flexible locking fingers which engage the terminals to hold them in place. The corresponding spacer element includes a plurality of rigid spacer fingers which extend between the locking fingers and which preferably cooperate with the fingers to surround the terminals which are engaged by the fingers. The spacer fingers hold the terminals in alignment and in proper position within the connector, and in addition serve to electrically isolate adjacent terminals. The spacer fingers and the receiver element locking fingers are interdigitated to form elongated terminal-receiving cavities within the connector housing component to hold the terminals parallel to each other. The plug component of the connector housing receives the pin terminal ends of harness wires, and these pin terminal ends extend through the spacer element of the plug connector component to provide parallel pins for connection to a socket connector component. These parallel pins preferably extend through the spacer element in parallel with the axis of the housing, and may be surrounded by a connector housing wall for protection.

In similar manner, the socket component of the connector housing includes a receiver element and a spacer element. These elements receive wire receptacle terminals in elongated terminal receiving cavities defined by interdigitated spacer fingers and receiver element locking fingers. The wire receptacle terminals do not extend beyond the spacer element, but instead are located in the receiving cavities. The receptacle terminals are aligned with corresponding axial apertures in the spacer element to receive the extending pins on the corresponding plug component of the connector when the two connector housing components are mated.

Both connector housing components may incorporate locking wedges which may be inserted through the front walls of the corresponding spacer elements and between adjacent locking fingers of the receiver elements to give added assurance of proper insertion and retention of the wire terminals during hand assembly of the connector. The flexible locking fingers are formed with locking shoulders which engage corresponding shoulders on the wire terminals so that when the wire terminals are inserted into the corresponding connector terminal-receiving cavities, the locking fingers are deflected out of the paths of the terminals, and when they are fully inserted, the locking shoulders snap into position behind corresponding terminal locking shoulders to secure the terminals firmly in the corresponding connector. This locking arrangement latches the wires in the connectors and prevents easy removal of the terminals so that during manual assembly, the assembler has a positive indication that the terminal is properly engaged in the connector. In addition, the latching operation ensures that the terminal will not accidentally fall out of the connector during assembly. However, access is provided to the ends of the locking fingers through the end wall of the spacer element in each connector housing so that if a wire is misassembled and must be removed from the connector, a release tool can be inserted into the connector to move the locking finger away from the terminal to disengage the locking shoulder and allow its removal. This requires careful shaping of both the locking fingers and the terminal ends of the wires so that the elements are properly engaged and secured.

When wiring harnesses are being manually assembled it often happens that some of the wires are not completely inserted in the connectors, allowing them to fall out of the connectors during handling or in use. This problem can be alleviated by the use of a locking wedge which is inserted into the connector component between adjacent locking fingers to prevent the fingers from flexing away from their normal, locking position. The wedge is inserted after all of the wire terminals are in place so that if any terminal is not fully inserted, so that its corresponding locking finger is in a flexed position, that finger will prevent the wedge from being inserted. Thus, the wedge provides an indication of the correct assembly of the wires in the connector. In addition, when the wedge is inserted into the connector, it prevents further flexing of the locking fingers and provides a secure lock for the terminals.

The shape of the locking shoulders on both the terminals and on the locking fingers are such that a positive latching is obtained when the terminal is properly seated in the connector. This positive latch prevents the terminal from pulling out of the connector without first releasing it, and as a result, the terminals will remain in place even without the use of a locking wedge. This is a significant benefit in automated assembly of harnesses, for it eliminates the need for the extra and complex step of inserting the wedge in the completed connector. In automated assembly machines, the problems that occur in manual assembly of harnesses are avoided, for the machine will automatically fully insert the terminals in the connectors. This assures that the terminals will be latched in position, and since the latching shoulders of the present invention will hold the fully latched terminals in the connectors, even during their use, the locking wedge is not essential. Of course, the use of a locking wedge is optional in machine-assembled harnesses, and may be desirable in some circumstances.

The two-part construction of the connector housing components allows the connector to be made with simpler molds than was previously possible with comparable plug and socket terminals for wiring harnesses and eliminates difficult coring in the manufacturing process. The two-part construction allows reduction of the overall size, and thereby lowers the overall cost of the connector, by allowing the locking fingers to be formed on one part of the connector component and the isolating spacer walls which separate the terminals and the locking fingers, to be formed on the other part of the connector component. As a result, the fingers can be made larger and stronger than would be possible in the manufacture of single-piece connector parts, while still leaving sufficient clearance between the edges of the fingers and the adjacent isolating walls (spacers) to enable the fingers to flex upon insertion of the wire terminals and engagement of the locking fingers with those terminals. This clearance can be smaller than could be provided in electrical connectors having plastic locking fingers formed by conventional single-piece mold techniques.

Another advantage of the molding technique of the present invention is that there is a separation between the core element, which is an inert spacing device depended on for no mechanical strength and the housing which forms the latching fingers for the retaining terminals or the feature which locks together plug and socket. The core element can therefore be fabricated using less glass filler than if it was one with the housing. Such reductions in glass filler content reduces the wear on the molds during manufacture of the connector parts, not only reducing maintenance and the cost of replacement of fragile mold and wire elements, but reducing flashing and other imperfections caused by wear of the mold.

The two-part connector of the invention eliminates the difficult-to-make, high-wear core elements previously required to make the connector in one piece, and reduces the thin, flexible core elements which tended to flex during the manufacturing of the plastic connectors.

Further in accordance with the invention, the plug and socket housing connector components discussed above receive and secure improved pin and receptacle wire terminals, respectively, which are precision formed and secured to the ends of interconnect wires which may be used in the formation of wire harnesses. The pin terminal is of hybrid construction; that is, it is not formed completely from sheet metal, but utilizes a solid wire nose, or pin end portion, secured to the interconnect wire by means of a formed metal body portion. The metal body portion is crimped onto the wire at its first, or rearward end, while its forward, or distal, end is crimped onto the solid nose portion to secure them together. The use of a solid wire nose produces a better tolerance control on the diameter of the mating surface of the pin terminal than was possible with prior metal forming techniques. This provides better control of the mating forces required to interconnect components, provides an additional area of mating contact by eliminating an undulating surface and a seam on a mating surface of a pin terminal, and provides better control of alignment of the terminal pin within the connector for mating. Furthermore, the solid wire nose is more cost effective since its manufacture generates less scrap metal than does a formed sheet metal pin. In addition, the better heat dissipation of the solid pin enhances the current carrying capacity of the connector.

The forward end of the metal body portion extends over, and is crimped onto, the rearward portion of the solid wire nose to hold it firmly. The forward end of the metal body is shaped, as by folding back its distal end on itself, to produce a radial locking shoulder surface which extends 360 degrees around the circumference of the wire nose. This locking shoulder is located along the length of the pin so as to engage a corresponding locking shoulder on a corresponding locking finger in the connector housing when the pin terminal is inserted. The locking shoulder on the pin terminal provides a flat, rearwardly-facing radial face which provides a positive, secure lock in the connector with only a minimum radial extension. This allows the terminal to be fed into the terminal cavity of the connector housing through a minimal diameter aperture, and insures a positive latch with the housing locking fingers.

The shape of the locking shoulder on the pin terminal also allows engagement of the shoulder with the corresponding locking shoulder on the locking finger in the connector housing with a minimum of motion of the locking finger within the housing. By limiting the required locking motion, the space required for this motion is reduced, thereby permitting a further reduction in connector size. In addition, this allows construction of a stronger locking finger to thereby reduce breakage of the connector during assembly of a harness and during the insertion of locking wedges to secure the wires in place. The flat radial locking shoulders also cooperate to provide a positive latching feel when the terminal is properly seated in the connector housing so that assemblers of harnesses will know when the wires are properly in place. In addition, this latching operation provides a reliable and permanent lock even without the use of a locking wedge. This feature is particularly important for use in automatic assembly of connectors and terminals, as has been discussed above.

The extension of the annular locking shoulder around the circumference of the pin terminal allows a non-oriented insertion of terminals into the connector housings to facilitate automated assembly of harnesses. This construction also eliminates the neck-down portions provided in prior wire terminal constructions and thus eliminates a source of stress and fatigue in the metal body which was a source of breakage and, by strengthening the terminal, permits smaller sizes.

The receptacle, or female, terminal for the harness wires is a two-part terminal end which is formed to provide an annular locking shoulder having a radially extending surface for engaging corresponding radially extending locking shoulders on locking fingers within the connector housing, in the manner described above with respect to the pin terminal. In the case of the receptacle terminal, the first, or rearward. end of a formed metal body portion is connected, as by crimping, to the terminal end of a connector wire, in conventional manner. The center end of the metal body portion is formed to be generally tubular, with its distal, or forwardmost, end being split to form two opposed tangs which are folded slightly inwardly toward the axis of the tubular center portion to provide a spring-loaded contact. The opening between the tangs receives the nose portion of a pin terminal when the plug and socket components are mated. The forward portion of the wire receptacle terminal includes a tubular sleeve which is axially aligned with and is secured, as by crimping, to the central part of the metal body portion. The forward open end of the sleeve is aligned with the interior of the metal body portion to serve as an eyelet which guides the mating pin terminal between the opposed tangs. The spring loading of the tangs cooperates with the fixed diameter of the sleeve to provide a firm contact with the pin terminal and thus secures the two terminals in mated relationship.

The rearward end of the tubular sleeve portion surrounds a central part of the formed metal body and provides a radially-extending, rearwardly-facing annular shoulder which will engage the locking fingers of a socket connector housing when the terminal is inserted therein. This terminal locking shoulder produces a well-defined edge to engage the locking shoulder on the connector locking finger to produce the positive locking operation described above. This connection also eliminates the neck-down design required with prior terminals, and thereby provides a stronger wire termination and permits a smaller package size than was previously obtainable.

Although the above-described form of the invention is preferred, it will be understood that variations may be made. For example, the relative locations of the forwardly-extending flexible fingers and the rearwardly extending nonflexible spacer walls on the two parts of the connector component can be reversed, if desired. In such a case the nonflexible spacer walls would extend forwardly in the connector component and the flexible locking arms would be molded separately and insertable between the walls and interdigitated to produce terminal receiver channels in the manner discussed above.

In such a case the locking shoulders on the rearwardly-directed flexible fingers would be reversed (with respect to the direction of extension of the finger), so that upon insertion of the terminals into the assembled two-part connector, the locking shoulders on the terminals would engage and latch the forwardly facing shoulder on the corresponding locking finger.

The combination of the two-part connector housings and the improved wire terminations described above result in a complete connector system which is not only more compact than was possible with prior designs, but can be used in waterproof systems, accommodates a larger number of wires for harnesses, permits use of the connectors in inline style connections or in header style connections on electronic components, provides positive locking of terminals in the connectors to insure proper assembly and to accommodate automated assembly, and provides stronger and more reliable electrical connections than were possible with prior wiring harness connectors of comparable size using plastic locking fingers.

BRIEF DESCRIPTION OF THE DRAWINGS

The foregoing, and additional objects, features, and advantages of the present invention will become apparent from the following detailed consideration of preferred embodiments thereof, taken in conjunction with the following drawings, in which:

FIG. 4 is a cross sectional view of the assembled component of FIG. 1, taken along line 2—2 of FIG. 1;

FIG. 5 is an end view of the spacer element for the socket component of FIG. 1, viewed in the direction of arrows 5—5 thereof;

FIG. 6 is an end view of a modified form of the spacer element of FIG. 5;

DESCRIPTION OF PREFERRED EMBODIMENTS

Figure 1:
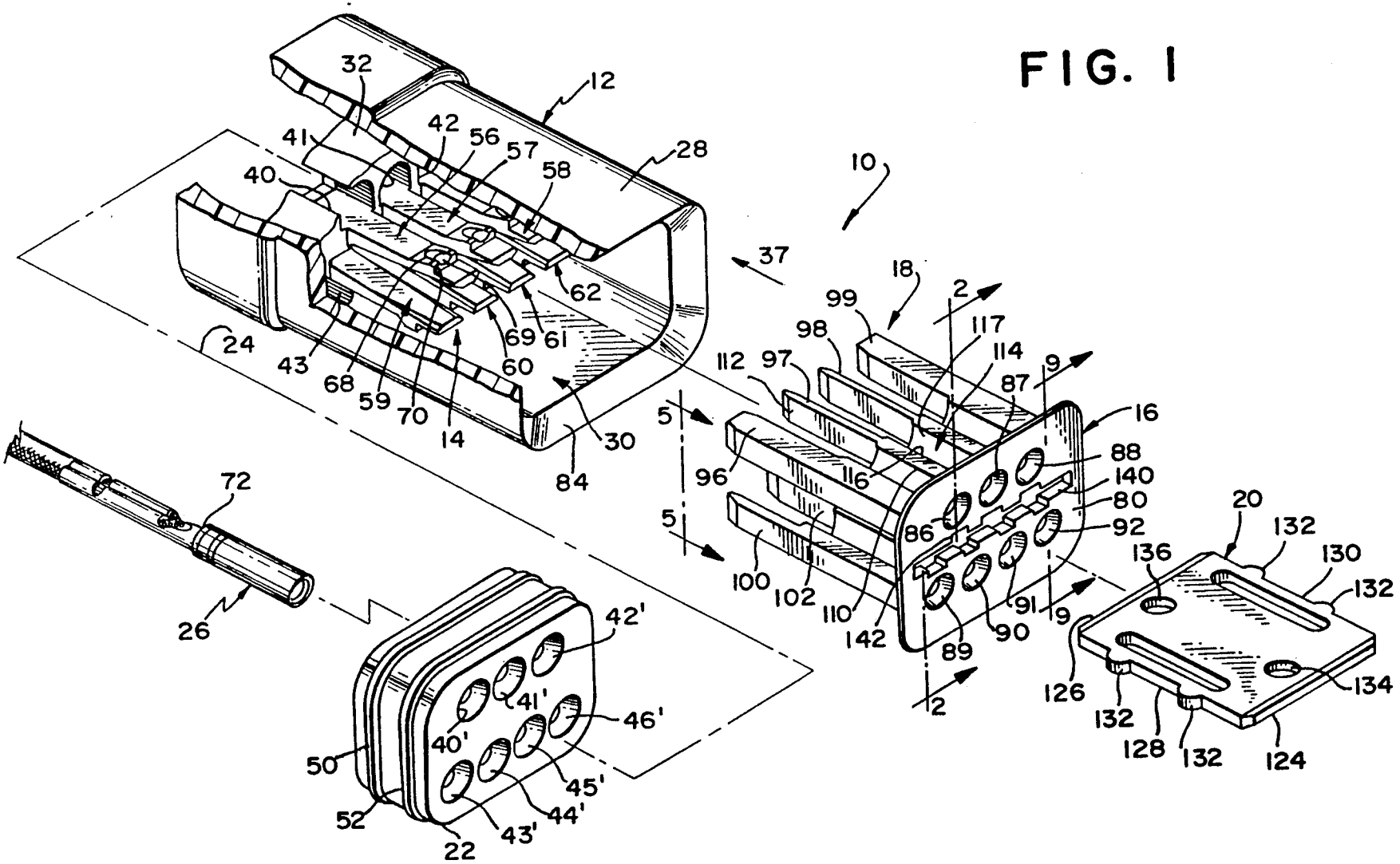
FIG. 1 is an exploded top perspective view of the socket component of the connector system of the present invention, showing a socket terminal therefor.

Turning now to a more detailed consideration of the present invention, there is illustrated in FIG. 1 a socket component 10 for a pin-type connector system constructed in accordance with the present invention. The socket component 10 includes a receiver element 12 which incorporates a plurality of locking fingers generally indicated at 14, a spacer element 16 incorporating a plurality of spacer fingers 18, a locking wedge 20 adapted to fit within the locking fingers to secure them in position, and an optional sealing plug 22 for closing an end of the receiver element 12. As illustrated by the dotted line 24, the sealing plug 22 can fit into the left-hand end of the receiver element 12, as viewed in FIG. 1, and the spacer element 16 fits into the right-hand end of the receiver element 12 with the spacer fingers extending between adjacent locking fingers to isolate them. Socket-type electrical wire terminals 26 are loaded through the sealing plug 22, if used, and into the interior of the assembled socket component 10, where they are releasably secured by the locking fingers 14 in alignment with corresponding apertures in the spacer element 16. The terminals 26 may be further secured, if desired, by means of the locking wedge 20 which fits between adjacent rows of locking fingers to assure the assembler that the terminals are in the proper position and to prevent the fingers from flexing, thus increasing the retaining force on the terminals.

Referring now to FIGS. 1, 2, 3 and 4, the receiver element 12 includes a housing shell 28 which surrounds a central, axially extending opening 30 which extends the length of the shell. A radially extending divider wall 32 divides the opening 30 into a rearwardly facing portion 34 and a forwardly facing portion 36. The housing shell may be of any convenient cross-sectional shape as viewed axially from its forward end, in the direction of arrow 37, and in the illustration of FIG. 1 is generally rectangular. However, it will be apparent that the shell may be circular or any other desired shape to accommodate the number and arrangement of the terminals mounted in it, and to accommodate the number and arrangement of terminals to which it is to be connected, such as the mating terminals in a corresponding plug element (to be described). Although not illustrated in FIG. 1, preferably the housing shell 28 is also provided with a suitable exterior fastener, generally indicated at 38 in FIG. 2, which provides a snap-acting connection between the socket component and the plug component of the connector system 10. This fastening mechanism will be further described hereinbelow.

The divider wall 32 includes a plurality of axially-extending apertures which, in the illustrated embodiment, are aligned in two horizontal rows across the width of the shell 28, with the apertures in the two rows being staggered to permit close spacing. Apertures 40 through 46 are provided, although only those numbered 40 through 43 are visible in FIGS. 1 through 4. These apertures are aligned with, and correspond to, apertures 40' through 46' which extend axially through the sealing plug 22 (FIG. 1). The sealing plug 22 may be secured in the rearwardly facing portion 34 of the central opening 30 of the socket element, and may include a pair of integral 0-rings 50 and 52 which extend around the periphery of the sealing plug to engage the inner surface of portion 34 and to provide a weather-proof seal, if desired. This sealing plug may be omitted, if desired.

Mounted on the forward surface 54 of divider wall 32 are a plurality of locking fingers which are elongated cantilevers extending axially into the forwardly facing portion 36 of the central opening 30 of the socket receiver element 12. The receiver element incorporates the same number of locking fingers as there are apertures in the wall 32, with each finger having one surface located adjacent a corresponding aperture and the opposite surface merging into the wall 32 between the apertures, to provide additional strength for the fingers. As illustrated in the figures, seven locking fingers 56 through 62 are provided in alignment with corresponding apertures 40 through 46, respectively. As most clearly illustrated in FIGS. 1 and 2, each locking finger includes a shank portion, such as the shank 64 on locking finger 56, which extends forwardly from the surface 54 in a cantilever fashion. The free, or distal end 65 of the shank 64 includes a raised shoulder portion 66 which has a bifurcated upper surface 68 (FIGS. 1 and 3 . This bifurcation of the upper surface is formed by a groove 69 which is shaped to facilitate engagement of the shoulder portion 66 of the locking finger with a corresponding locking shoulder on a cylindrical terminal such as the terminal 26. The forward edge of the shoulder portion 66 is formed by a flat, radially extending locking surface 70, which, as illustrated in FIG. 1, extends around the groove 69 and serves as a locking shoulder to engage a corresponding terminal locking shoulder 72 on terminal 26. The free end 65 of the locking finger incorporates a release tip 74 which is shaped to permit the locking finger to be flexed by means of a tool inserted through the spacer element, to release a corresponding terminal which has been engaged thereby.

Figures 2, 3:
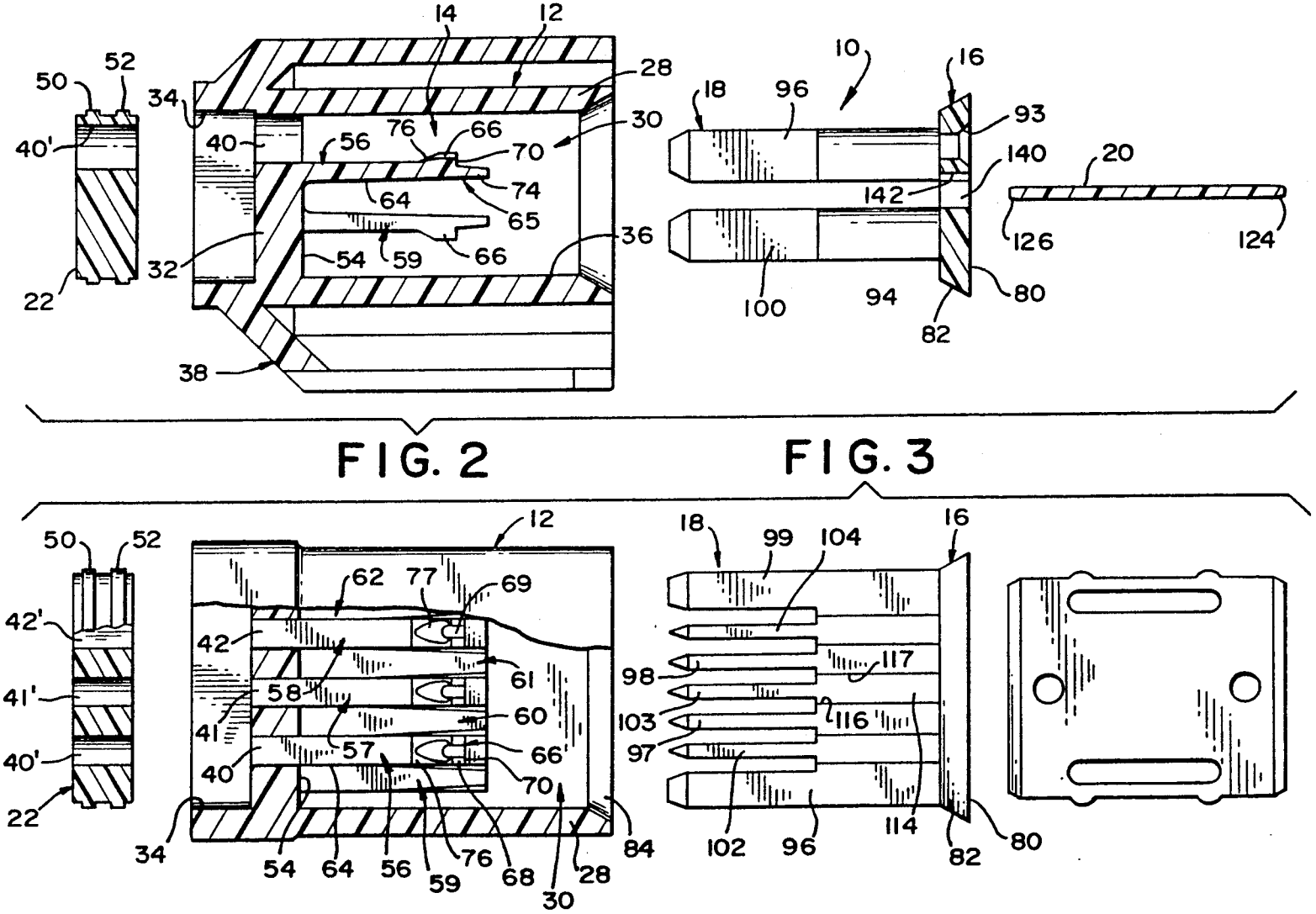
FIG. 2 is a cross sectional view of the component of FIG. 1 taken along line 2—2 thereof.
FIG. 3 is a top elevational view, partially broken away, of the component of FIG. 1.

As illustrated for finger 56 in FIGS. 1 and 2, the upper surfaces of the locking fingers are aligned with their corresponding apertures in divider wall 32 so that a terminal may be inserted through the aperture and along the locking finger to engage the shoulder 66 without obstruction. The cantilevered fingers are flexible, and a rearwardly facing portion 76 of the shoulder 66 is sloped downwardly and incorporates a groove 77 to form a ramp which is initially contacted by the forward end of the terminal which is being inserted into the connector component. This causes the finger to flex downwardly (in the case of finger 56) to allow the terminal to pass over the front edge of the shoulder 66, at which time the finger moves back to its original position to cause groove 69 to engage the reduced shank portion of the terminal and to produce positive engagement of shoulder 72 with the locking surface 70. As illustrated, each of the locking fingers is similarly constructed, with their respective shoulder portions aligned with their corresponding axial apertures so as to engage terminals which extend through those apertures. Thus, the fingers 56 through 58, which are mounted at the bottoms of their respective axial apertures, have shoulders which face upwardly, while locking fingers 59 through 62 are located above their corresponding apertures 43 through 46 and thus have shoulder portions which face downwardly so that the shoulder ramps will engage inserted terminals. The locking fingers in the top row are offset from those in the bottom row to provide space for an anti-overstress rib for the flexible finger opposite (to be described), and the rows are spaced far enough apart to permit them to flex when the terminals are inserted. The grooves on the ramp surfaces enable the terminals to be inserted with less deflection, thereby allowing closer spacing of fingers and permitting smaller connectors, and further permit a wrapping of the locking surfaces around the axis of the terminal to provide a more secure connection.

Preferably, the locking fingers are angled slightly inwardly with respect to the axes of their corresponding apertures so that the ramps 76 lie in the path of terminals inserted into the receiver element 12 to insure a positive engagement of the locking fingers with their corresponding terminals. The shank portions of the locking fingers are sufficiently flexible to allow the fingers to bend outwardly out of the path of the terminals and to cause them to return to their initial position when the terminal locking surface 72 has passed by the shoulder portion 66 on the corresponding finger, to provide a positive locking action. The relationship between the locking surface 72 of the terminal and the radially extending locking surface 70 of the locking fingers is most clearly illustrated in the assembled structure of FIG. 4.

In order to insure that the terminals, when inserted into the socket receiver element 12, travel along the fingers to engage their corresponding locking shoulders and remain in engagement with them even under adverse conditions such as Vibration the like, the spacer fingers 18 of spacer element 16 are inserted between adjacent locking fingers 14 by placing the spacer element in the forwardly facing portion 36 of the central opening 30 within the receiver element 12. When the spacer element 16 is slipped into position, the spacer fingers 18 are interdigitated with the locking fingers 14 to form receiver channels for the terminals to guide the terminals into place and to insure electrical isolation between them.

As illustrated in FIGS. 1 to 3 and 5, the spacer element 16 includes an end plate 80 having a tapered peripheral edge 82 which is shaped to engage a correspondingly tapered forward edge 84 formed on the housing shell 28 of the receiver element 12 when the two elements are assembled. The end plate incorporates a plurality of axially extending apertures arranged in rows across the width of the end plate, with three apertures 86, 87 and 88 being formed on the top row and four apertures 89, 90, 91 and 92 being formed on the bottom row in the illustrated embodiment. These apertures are chamferred at their forward ends, as illustrated at 93 in FIG. 2, and correspond to, and are axially aligned with, the apertures 40 through 46 in the receiver element 12 and apertures 40' through 46' in the sealing plug 22 to form a part of the receiver channels described above. Secured to the rear surface 94 of the end plate 80 are the corresponding spacer fingers 18 which are formed as a part of the end plate 80 and which extend axially rearwardly on opposite sides of the apertures 86 through 92. Thus, elongated spacer fingers 96 and 97 are located on opposite sides of aperture 86, fingers 97 and 98 are on opposite sides of aperture 87, and elongated fingers 98 and 99 are on opposite sides of aperture 88 in the top row of apertures. Similarly, the elongated fingers 100 through 104 are spaced on opposite sides of their corresponding apertures 89 through 92 in the bottom row.

The elongated fingers are shaped to have a relatively thickened shank portion at their near ends, adjacent the rear face 94 of the end plate, and are relatively thin at their far ends, as best seen in FIG. 1. Thus, for example, the finger 97 includes a shank portion 110 at the inner end of the finger adjacent the end plate, and a thinner isolating portion 112 at its free, or distal end. The shank portion 110 cooperates with similar portions of adjacent fingers to provide an alignment region such as the region 114 between adjacent fingers 97 and 98. This alignment region is beyond the free ends of the locking fingers 14 and receives the end of a terminal 26 when the device is assembled (see FIG. 4). The region 114 aligns the terminal 26 with its corresponding axial aperture, such as aperture 87, in the end plate 80.

The thin isolating portions 112 of the spacer fingers 18 extend between corresponding adjacent locking fingers, such as spacer finger 97 extending between locking fingers 56 and 57 of the receiver element 12, to provide electrical and mechanical isolation between adjacent electrical wire terminals mounted in the connector component. The thin portions 112 of the spacer fingers 18 are coextensive with their corresponding locking fingers 14 so that the spacers do not interfere with the flexing motion of the locking fingers when the wire terminals are to be inserted or released. The thickened shank portions are sufficiently short to avoid contact with the ends of the locking fingers when the connector component is assembled, again to insure freedom of movement of the locking fingers with respect to the spacers. It will be noted that the shank portions 110 preferably have inner surfaces which are shaped to accommodate the shape of terminal 26. Thus, for example, the adjacent shank portions for spacer fingers 97 and 98 have opposed curved surfaces 116 and 117 which define the opposite sides of the alignment region 114. The remaining spacer fingers are similarly constructed, to provide alignment regions for each of the apertures 86 through 92.

When the receiver element 12 and the spacer element 16 are assembled so that the locking fingers and the spacer fingers are interdigitated, the corresponding fingers form terminal receiver channels, such as the channels 120 and 122, illustrated in FIG. 4. Each channel consists of an axial aperture in the divider wall 32, such as the aperture 40, a locking finger such as the finger 56 which forms the bottom wall of the terminal receiver channel, a pair of side spacer fingers, such as the fingers 96 and 97, and a spacer element aperture, such as the aperture 86, all axially aligned to provide a channel for receiving a terminal such as the socket-type terminal 26 illustrated in FIG. 1 and in FIG. 4 It will be understood that if a sealing plug such as the plug 22 is used with the device, a corresponding aperture such as the aperture 40' would also form a part of the terminal receiver channel.

The socket receiver element 10 is assembled by sliding the spacer element 16 into the central opening 30 of the shell 28 so that the end plate 80 engages the tapered edge 84 of the shell. The spacer element 16 may be held in position within the shell 28 by the friction of the outermost spacer elements 96, 99, 100 and 104 against the inner surface of the housing shell 28, may be held in place by snap-action latches (not shown) on the surface 94 of the end plate which engage corresponding notches (not shown) formed on the inner surface of shell 28, may be held by means of suitable adhesives, or may be held by any other suitable mechanism. If a sealing plug is to be used, it may then be positioned in the rearwardly facing portion 34 of the central opening, as illustrated in FIG. 4. Thereafter, a multiplicity of terminals 26, a total of seven terminals in the illustrated example, are inserted in their corresponding terminal receiver channels and are latched into place by their corresponding locking fingers.

Insertion of the terminals 26 causes the locking fingers 14 to flex outwardly away from the axes of their corresponding channels as the end of the terminal engages the ramp portions 76 thereof, and to return to their original, unflexed position to cause the locking surfaces 70 to engage the corresponding surfaces 72 on the corresponding terminals to thereby latch the terminals in place. The latched terminals are then in alignment with their corresponding axial apertures in the spacer element, as previously described.

When automated or machine insertion of the wire terminals into the connector is used, the terminals will normally be securely locked in position by the locking fingers, for the sharp edges on the engaged locking shoulders and the radially extending locking surfaces will securely hold the terminals in place. However, if the terminals are to be inserted into the connectors by hand, occasionally a terminal will not be fully inserted, and thus not in its properly locked position. In order to insure that the terminals are fully inserted in hand assembly, then, the locking wedge 20 is provided.

As illustrated in FIG. 1, wedge 20 is a generally rectangular block which is sufficiently wide to extend transversely across the interior of the housing shell 28 between the upper and lower rows of locking fingers. The locking wedge includes tapered forward and rearward edges 124 and 126 and side edges 128 and 130 which may incorporate shoulders 132 to engage corresponding detents (not shown) in the side wall of the housing shell 28 to hold the wedge in place and in alignment. Through apertures 134 and 136 are provided in the wedge 20 to assist in its removal from the socket component.

The wedge 20 is placed in the socket component through a slot 140 formed in the end plate 80 and extending transversely across the end plate between the upper row of apertures 86–88 and the lower row of apertures 89-92. The wedge extends through the slot and between the upper and lower spacer fingers as well as between the upper and lower locking fingers, as illustrated in FIG. 4. If any of the fingers are out of position, as would be the case if one of the terminals 26 is not fully inserted so that the corresponding finger is still in a flexed position, the wedge cannot be fully inserted, and this will provide a positive indication of the faulty assembly of the connector. However, when all of the terminals are fully inserted and latched, the wedge will slide fully into place, in the manner illustrated in FIG. 4. When the wedge is in place, it prevents the locking fingers from moving outwardly from their corresponding terminal receiver channels and thereby prevents them from unlatching. Thus, the wedge also provides a locking function to prevent release of the terminals, for example, for added security when the connector is to be used in particularly adverse conditions.

As illustrated in FIGS. 1 and 5, the slot 140 in the spacer element 16 incorporates a plurality of notches such as the notch 142. Each notch is adjacent a corresponding aperture in end plate 80, such as the aperture 86, and is generally aligned with the release tip 74 of the corresponding latching finger, such as the finger 56. The notches provide access to the release tips on the locking fingers to permit insertion of a tool, such as a screwdriver, which can engage the top surface of the release tip and press it down, in the case of the top row of locking fingers, or press it upwardly, in the case of the bottom row of locking fingers, to release the corresponding terminal.

Although the socket component 10 is illustrated as having two rows of terminal receiver channels in a generally rectangular connector housing, it will be understood that additional rows may be added and the overall shape of the connector can be changed to accommodate those additional terminal channels. For example, a third row of channels may be incorporated immediately below the row which includes apertures 89 to 92 and a fourth row below that, with the third and fourth rows being essentially duplicates of the bottom and top rows, respectively, of the illustrated connector component. Various other arrangements will be apparent to those of skill in the art.

The receiver element 12 and the spacer element 16 are each unitary, molded plastic parts which may be manufactured relatively easily and to very close dimensional tolerances through the use of conventional molding techniques. Because the elements are manufactured separately, a close spacing of adjacent locking fingers and spacer fingers can be attained without undue complexity in the molding techniques, thus allowing a closer fit between moving and stationary parts. Furthermore, the locking fingers can be made larger and stronger than would be possible with a unitary connector part, while still leaving sufficient clearance between the edges of the locking fingers and the adjacent isolating spacer fingers so that the locking fingers can flex to permit insertion of the wire terminals and engagement of the locking fingers with the locking shoulders. This clearance can be smaller than the space that could be provided by conventional designs using a single-piece molding, while still providing freedom of movement of the locking fingers In addition, the present two part construction of the connector component allows the connector receiver channels to be individually shaped to provide the desired electrical isolation to improve the connector while at the same time allowing simplified tooling and reduced manufacturing costs by eliminating fragile core sections. Further, the construction still allows a positive latching action which facilitates automated assembly of wiring harnesses, while the release mechanism allows easy correction of assembly errors in hand assembled processes.

The separate molding of the spacer element 16 and receiver element 12 provides the opportunity to shape the elements in ways that would not be practical or even possible with conventional molds in the manufacture of a single- piece socket component. For example, as illustrated in FIG. 6 at 146 the spacer element 16 can be modified to provide essentially circular receiver channels to provide improved terminal isolation. The modified element has an end plate 148 having a tapered peripheral edge 150, the end plate including a first row of apertures 152 to 154 and a second row of apertures 155 to 158. A slot 160 is also formed in the end plate in the manner discussed above with respect to the slot 140 in end plate 80. In this modified version, the spacer element 146 includes an upper row of interconnected spacer fingers 162 through 165 and a lower row of interconnected spacer fingers 166 through 170. These fingers are elongated, with relatively thick shank portions and relatively thin end portions in the manner discussed above with respect to spacer fingers 96 through 104 forming a part of element 16. The difference, however, is a continuous bridging portion 172 which extends between fingers 162 and 165 and a continuous bridging portion 174 which extends between fingers 166 and 170.

The bridging portion 172 extends along the tops of apertures 152 through 154 (as viewed in FIG. 6) while the bridging portion 174 extends under the apertures 155 through 158, again as viewed in FIG. 6. The bridging portions are curved around the respective apertures so that the shank portions of the fingers and the connecting bridging portions therefor extend around their respective apertures to form substantially continuous cylindrical walls, such as the wall 176 around aperture 152, for the terminal receiver channels. Similar substantially cylindrical walls surround each of the other apertures to provide added rigidity for the spacer element 146 and its elongated spacer fingers, and to provide additional isolation and protection for the ends of the terminals 26 as well as more accurately to align them with their corresponding spacer element apertures.

Figure 7:
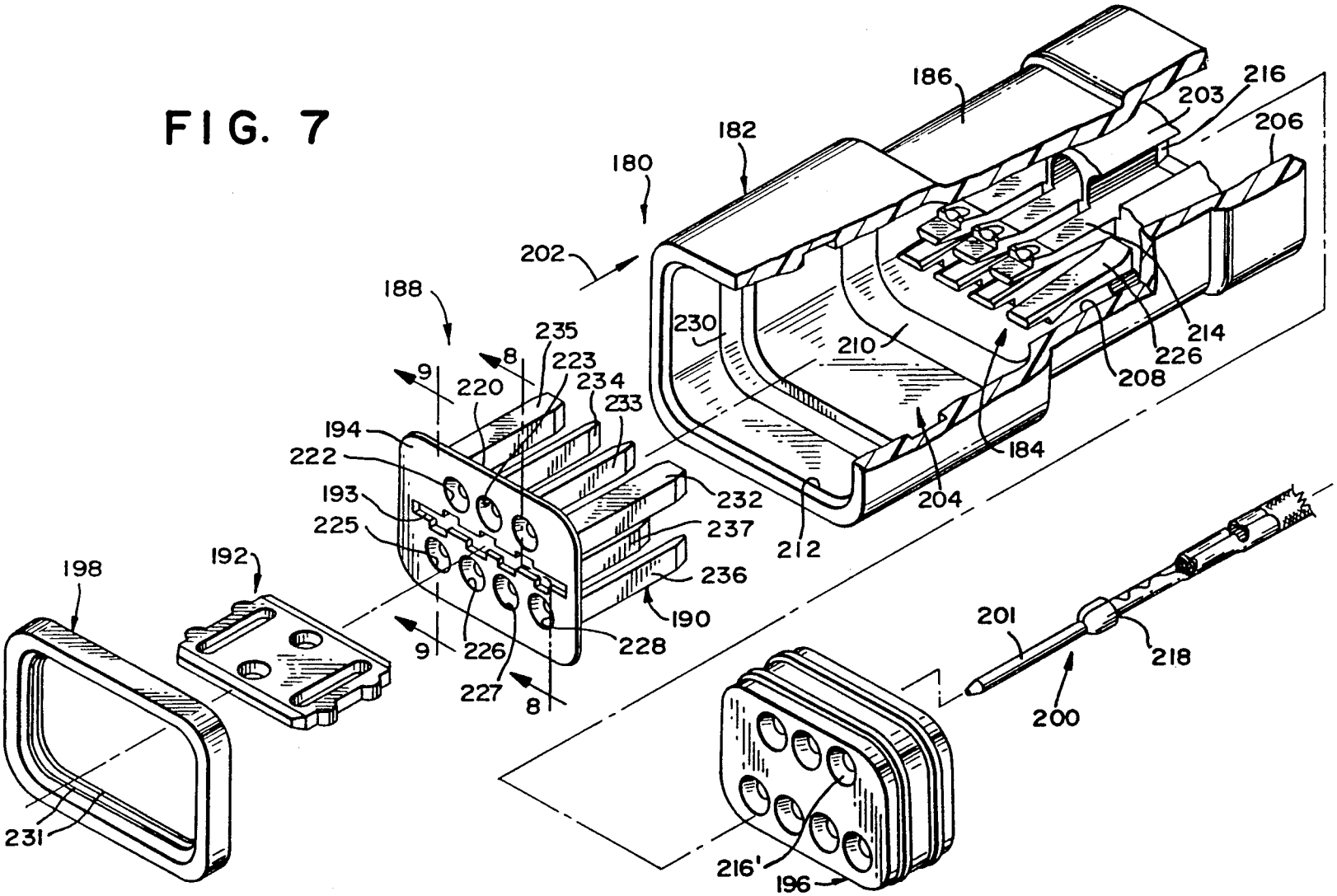
FIG. 7 is an exploded top perspective view of a plug component for the connector system of the present invention, showing a pin terminal therefor.
Figure 8:
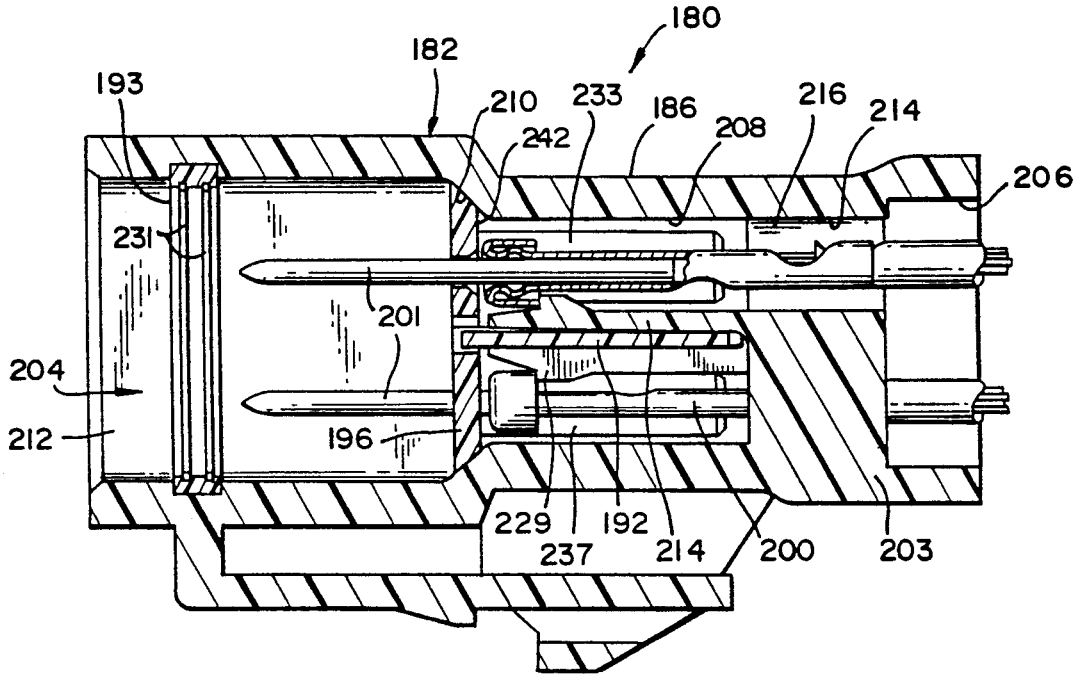
FIG. 8 is a cross sectional view of the assembled component of FIG. 7, taken along lines 8—8 thereof.

Turning now to a consideration of FIGS. 7 and 8, the second component of the connector system of the present invention is the plug component which is constructed to mate with the socket component described above. This plug component, which is illustrated in an exploded view in FIG. 7, and is generally indicated at 180, is similar in structure to the socket component 10, in that it includes a receiver element 182 having a plurality of locking fingers 184 extending axially within a housing shell 186. The plug component 180 also includes a spacer element 188 having a plurality of rearwardly extending elongated spacer fingers 190 which cooperate with the locking fingers 184, when the spacer element is positioned inside the housing shell 186, to form a plurality of terminal receiver channels within the plug component. A locking wedge 192 is also provided for insertion through a slot 193 in the end plate 194 of the spacer element to fit between adjacent rows of the receiver element locking fingers 184 to provide assurance that the wire terminals are in their locked position, and prevent them from being retracted, in the manner discussed above with respect to FIG. 1.

Figure 9:
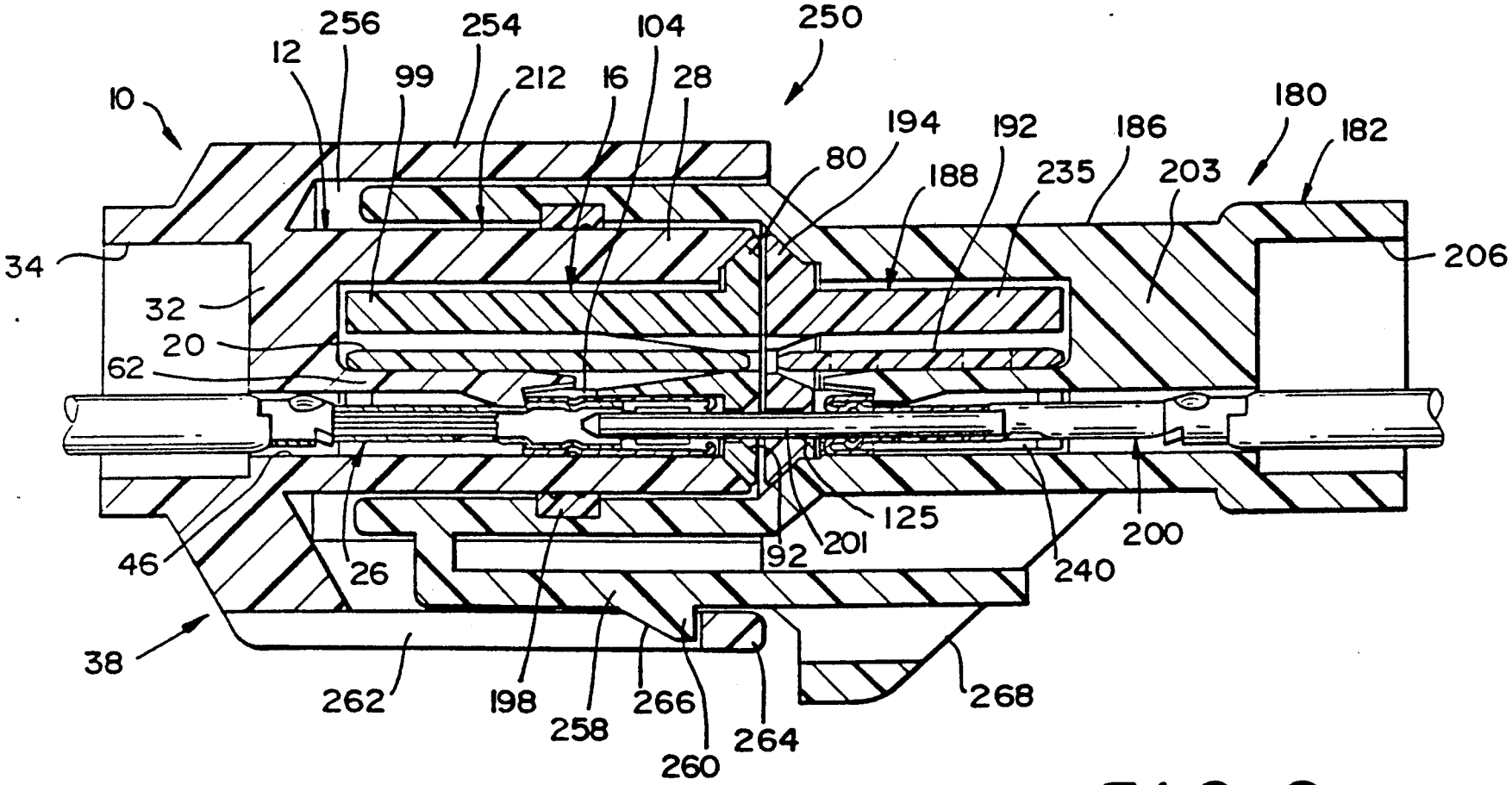
FIG. 9 is a cross sectional view of the connector of the present invention, showing the socket and plug components of FIGS. 1 and 7 assembled and in mated relationship, taken along lines 9—9 of FIGS. 1 and 7.

The plug component 180 may include a sealing plug 196 for closing the rearward end of the plug receiver element 182, and a sealing ring 198 is provided for the forward end of the receiver element housing shell 186 to provide alignment as well as a weather-tight seal between the plug component 180 and the socket component 10 (FIGS. 1 and 4) when the two components are mated together in the manner to be described, and as illustrated in FIG. 9.

The plug component 180 receives pin-type terminals 200, which extend through the optional sealing plug 196 and into corresponding terminal receiver channels within the receiver element 182, where they are latched in place by their corresponding locking fingers 184. Pin portions 201 of the terminals 200 extend forwardly through corresponding apertures in the end plate 194 to extend into a forward region of the housing shell 186 for engagement with the corresponding receptacle terminals 26 carried by the socket component 10.

The housing shell 186 is shaped to receive the socket component 10 in the preferred embodiment illustrated in FIGS. 7 and 8, so the housing shell 186 is generally rectangular in shape as viewed axially in the direction of arrow 202. The housing shell 186 includes a radially extending divider wall 203 which divides the interior 204 of the housing shell into a rearwardly facing portion 206 and a forwardly facing central portion 208, the portion 208 surrounding the locking fingers 184. At the forward ends of the locking fingers, the shell tapers outwardly at a tapered wall portion 210 to a forward housing portion 212 which is sufficiently large to fit over the outside of the forward portion of the socket component housing shell 28 so that the two components can telescope together in order to bring the terminals 26 and 200 into mating relationship. The illustrated embodiment is for a waterproof connector, and this provides the enlarged housing portion 212 on the plug component 180 for telescopically receiving the socket component 10. However, the relative sizes of the housings may be different in other applications.

Integrally molded with the divider wall 203, and extending generally axially forwardly therefrom, are the plurality of locking fingers 184. These fingers, such as the finger 214, are aligned with corresponding apertures, such as the aperture 216 extending through the divider wall 203, so that upon insertion of a pin terminal, such as the terminal 200, into aperture 216, the pin terminal will be guided generally axially into the receiver element. The forward end of the pin terminal will engage a shoulder formed on the locking finger to cause the finger to deflect away from the axis of the aperture to permit further insertion of the pin terminal in the same manner that terminal 26 is inserted into plug component 10, as described above. As illustrated in FIG. 7, each pin terminal includes a rearwardly facing radial locking surface 218, to be further described hereinbelow, which will engage a corresponding forwardly facing radial locking surface on the shoulder of a locking finger 214, which surface is similar to the locking surface 72 on locking finger 56 (FIG. 2). The passage of the terminal locking surface past the shoulder permits the locking finger to return inwardly toward the axis of the corresponding aperture to latch the terminal in place. The structure and operation of the latching fingers 184 are similar to the structure and operation of the latching fingers 14 illustrated in FIG. 1.

To complete the formation of terminal receiver channels in the plug component 180, the spacer element 188 is slipped into the forward end of the housing shell 186, the spacer element passing through the forward region 212 until a tapered peripheral edge 220 of the end plate 194 engages the tapered wall portion 210 of the housing shell. In seating the spacer element into the plug receiver element, the spacer fingers 190 are interdigitated with the locking fingers 184 in the manner described above with respect to FIG. 1 to thereby provide along and around each of the locking fingers 184 a corresponding terminal receiver channel.

The end plate 194 of the spacer element 188 includes a top row of apertures 222, 223 and 224, and a bottom row including apertures 225 to 228. The apertures are staggered with respect to each other as illustrated, and are aligned with corresponding terminal receiver channels between adjacent spacer fingers and either above or below corresponding locking fingers 184. When the spacer element is in place Within the shell 186, as illustrated in FIG. 8, and the terminals 200 are latched into place, the terminal pins 201 extend through corresponding apertures 222 through 228 of plate 194 and into the forward housing region 212, again as illustrated in FIG. 8. When the terminals are in place, a wedge 192 may be positioned between the upper and lower rows of locking fingers 184 by inserting the wedge through slot 193 to verify that the terminals are properly latched after manual assembly. The wedge thus engages the bottoms of the fingers in the top row, such as finger 214 and the tops of the fingers in the bottom row, such as finger 229, as illustrated in FIG. 8. The wedge also serves to hold the locking fingers in their latched position, if desired, as discussed above.

The sealing ring 198 can be positioned in a groove 230 formed on the interior surface of the forward housing region 212, the groove securing the sealing ring in place. Preferably, the sealing ring includes a pair of integral 0-rings 231 on the interior surface thereof, these rings engaging the exterior surface of shell 28 when the socket and plug components are mated.

The fingers 190, as illustrated in FIG. 7, do not include a thickened shank portion, as do the spacer fingers 18, since the spacer fingers 190 are substantially coextensive with the locking fingers 184 when the plug component is assembled; instead, the fingers are of constant width throughout their length in order to provide clearance for the locking motion of the locking fingers. Thus, the spacer fingers 232–240 are located on opposite sides of their corresponding locking finger 184 so that, for example, spacer fingers 232 and 233 are on opposite sides of locking finger 214 and spacer fingers 236 and 237 are located on opposite sides of the locking finger 229, with the tip ends of the respective locking fingers being adjacent the rear surface 242 of the end plate 194.

FIG. 9 illustrates the assembled socket and plug components 10 and 180 of FIGS. 4 and 8, respectively, in their joined, or mated condition, to form the connector 250 of the present invention. The socket component 10 is generally indicated at the left hand side of FIG. 9, while the plug component 180 is generally indicated at the right hand side of the Figure. The cross sectional view of this figure is taken along lines 9—9 of FIGS. 1 and 7, the cross section bisecting the terminal receiver channel which corresponds to spacer element aperture 92 for the socket component and the plug terminal receiver channel which corresponds to the aperture 125 in spacer element 188. As illustrated, the housing shell 28 of the socket component is telescoped within the forward housing region 212 of housing shell 186 so that the pin terminals 200 carried by the plug component 180 are in alignment with the socket terminals 26 carried by the socket component 10. As the two components are assembled, the pin terminals 201 are guided by the chamferred edges 93 of the spacer element 80 to engage the corresponding socket terminals 26 to provide the desired electrical connection between the two terminals.

Since both the pin and the socket terminals are positively latched in position by their respective component locking fingers, and since the socket terminals are held in firm alignment with the apertures in their corresponding spacer elements by the locking and spacer fingers, while the pin terminals are secured in alignment by their corresponding spacer element apertures, a firm and positive electrical connection is easily and accurately made. Although the cross section of FIG. 9 shows only one set of terminals being connected, it will be apparent that the terminals in each of the other terminal receiver channels of both the socket and the plug components will similarly be interconnected as the plug and socket components are pressed together.

It will be noted that the 0-rings on the sealing ring 198 engage the outer surface of the housing shell 28 to provide a water resistant connection between the components. Although FIG. 9 does not show the sealing plugs 22 or 193, it will be apparent that such sealing units may be incorporated in the connector components to provide weather proofing.

In a preferred form of the invention, the plug and socket components 10 and 180 incorporate a suitable latching mechanism 38 which releasably holds them in the assembled condition illustrated in FIG. 9. This latching mechanism is generally indicated at 252 in FIG. 9 and includes a shroud 254 which encircles the housing shell 28 and provides a generally annular cavity 256 which receives the forward portion of the housing shell 186. Shell 186 carries on one side a spring latch arm 258 having an upstanding latching shoulder 260. Located in the shroud 254 is a latching slot 262 which is aligned with the shoulder 260 when the components are assembled and which is closed at its distal end by a latch receiver 264. The latching shoulder 260 has a forward ramp surface 266 which engages the receiver 264 as the components are assembled, the ramp forcing the spring latch arm 258 inwardly toward the body of the connector as the locking shoulder passes beneath the receiver 264. When the latching shoulder passes into the slot 262, the latching arm springs outwardly to lock the components together, in the manner illustrated in FIG. 9. To separate the components, the latching arm is depressed inwardly to release the latching shoulder 260 and the components are drawn axially apart from each other. The plug component 180 carries a protective cover element 268 which, when the components are in the assembled condition of FIG. 9, covers and protects the end of the latching arm 258 to prevent accidental disengagement of the latching shoulder. Alternative latching mechanisms may be provided.

Figure 10:
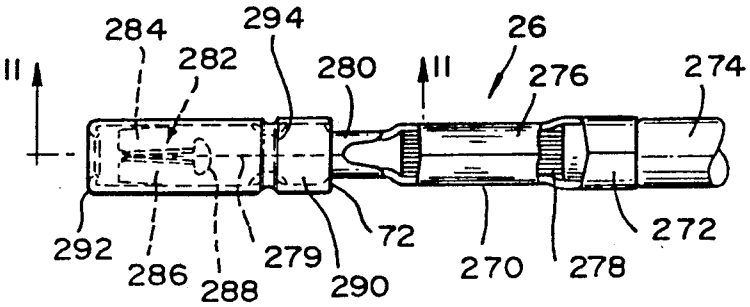
FIG. 10 is a top plan view of the socket terminal illustrated in FIG. 1.
Figure 11:
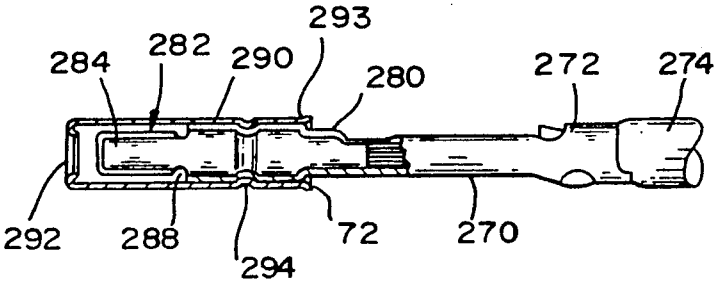
FIG. 11 is a partially broken away side elevation view of the terminal of FIG. 10, with the terminal shown in cross section along line of FIG. 10.

The socket terminal 26 is illustrated in greater detail in FIGS. 10 and 11, to which reference is now made. As there shown, this terminal is a two-part unit which provides a firm attachment to a lead wire and provides a positive and reliable electrical contact with a corresponding pin terminal. The terminal 26 includes a sheet metal body portion 270 which is precision formed to have a first crimping portion 272 which surrounds and is crimped onto the insulating cover of an electrical connector wire or cable 274 to secure the body portion thereto. The body portion further includes a second crimping region 276 which is formed to be crimped onto the bare wire strands 278 of the cable 274 to provide an electrical connection thereto.

The body portion extends beyond the end of the strands 278 and is precision formed so that its edges are joined at 279 to provide a generally cylindrical head 280 which is bifurcated at its distal, or outermost, end 282 to form a pair of opposed contact fingers 284 and 286. These fingers are generally semicircular in cross section and are bent slightly inwardly toward each other, as illustrated in FIG. 10, so as to provide a spring-loaded grip on the pin portion of a pin terminal which is inserted therein so as to make a firm electrical contact therewith. A cutout 288 is formed at the base of the contact fingers to permit them to be bent slightly inwardly so as to provide the requisite spring action in the metal.

A cylindrical hood 290 surrounds the head 280 and extends slightly beyond the ends of the bifurcated contact fingers 284 and 286, with the open forward end 292 of the hood forming an eyelet 292 which serves to guide a pin terminal into the interior of the receptacle formed by the head 280 and the contact fingers 284 and 286. As illustrated, the forward end of the hood preferably is folded inwardly to provide a rounded inlet for the pin terminal and to provide a guide for the pin to ensure that it enters the receptacle in an axial direction to preclude overstressing of the spring contacts during handling and mating with the pin terminals. The rearward end of the hood 290 is formed slightly outwardly at 293 to produce the shoulder surface 72. The surface is annular and extends radially outwardly from the cylindrical head of the terminal body portion to thereby provide a substantially planar latching surface normal to the axis of the terminal body which provides a positive lock for the terminal when it is inserted into a terminal receiver channel in the socket component. The hood 290 preferably is crimped onto the head portion 280, as by means of the crimp 294 which extends annularly around the hood.

Figure 12:
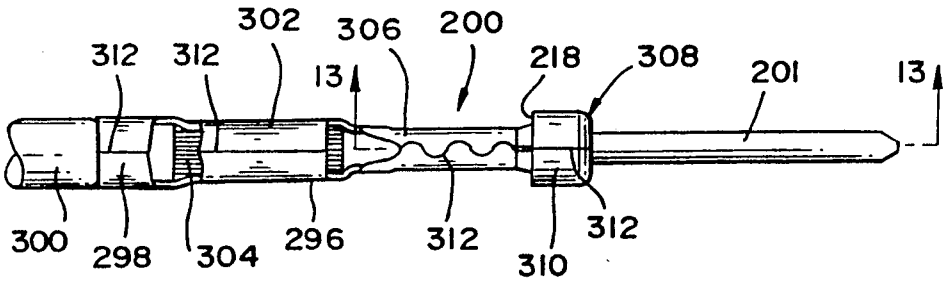
FIG. 12 is a top plan view of the pin terminal illustrated in FIG. 7.
Figure 13:
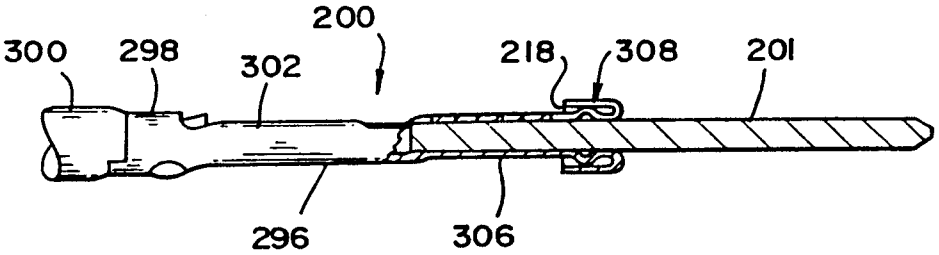
FIG. 13 is a partially broken away side elevational view of the pin terminal of FIG. 12, shown in cross section along lines 13—13 of FIG. 12.

The pin terminal 200 is illustrated in greater detail in FIGS. 12 and 13, to which reference is now made. As there illustrated, this terminal is a two-part hybrid terminal which utilizes a precision formed sheet metal body to grip a solid wire terminal pin 201. The stamped sheet metal body portion is illustrated at 296 and includes a first crimping portion 298 which is at the rearwardmost portion of the terminal and which is crimped onto the insulating cover of a connector wire or cable 300. A second crimping portion 302 is formed on the body and is crimped onto the bare wire strands 304 of cable 300. The forward portion of the body 296 is formed in a generally cylindrical shape as at 306, while the distal end 308 of the body portion is folded back on itself to form a double-walled head portion 310 having a rearwardly facing annular edge 218 which forms a substantially planar, radially extending locking surface, as described above with respect to FIG. 7.

The body portion of the terminal is formed from a flat metal stamping which is precision formed into a generally cylindrical form as illustrated, with the outer edges of the stamping being brought together a at the joint line 312 to form the crimps at 298 and 302 and to enable the forward portion thereof to be drawn around and tightly crimped onto the outer surface of the solid metal pin 201 so that the pin is secured in the body portion 306. The joint line also permits the head portion 310 to be formed by folding back the distal end of the metal as it is formed around the pin.

As has been described above, pin terminals 200 are inserted into the corresponding terminal receiver channels in the plug component 180 of the connector system of the present invention with the annular surface 218 engaging the corresponding shoulder locking surface on the locking fingers in the plug receiver element so that the pins are held firmly in place.

The terminals illustrated in FIGS. 10, 11, 12 and 13 produce significant advantages over prior terminal structures in that they provide excellent terminal alignment and mating reliability, provide positive latching in their corresponding connector components, provide excellent strength and durability for their size, as well as ease of assembly in connectors. In addition, they provide a significant reduction in the amount of metal required, thereby permitting the use of higher quality materials with higher current ratings at a lower terminal cost. Furthermore, the use of a solid wire pin terminal eliminates a seam on an electrical contact surface, thereby providing better contact and an improved current rating for the same pin diameter formed from sheet metal. It also reduces the amount of tooling required to form the terminal, and improves the tolerance obtainable for terminal dimensions so as to provide better alignment and lower force for mating. The receptacle terminal provides an improved contact with the pin terminal, and both constructions provide annular radial locking shoulder surfaces so that the terminals can be inserted in their corresponding connectors without concern for the orientation of the terminal as it is being inserted.

Thus, there has been provided a unique connector system which incorporates two-part socket and plug components and which are adapted to receive unique wire terminals for wires and cables which may form parts of wiring harnesses or the like. The wires or cables are easily assembled into the connector components, and are removably latched in position so that if errors are made during assembly, the errors can be easily corrected without having to discard the assembly. The insertion of the wires into a fully latched condition in the connector components may be assured by means of locking wedges which are also removable, if desired, and the plug and socket components are easily connectable to each other or to other socket or plug connectors for in line use or for use with headers or other electrical components. The system of the present invention provides significant reductions in the size of the plug and socket components through the use of a two-part construction, while maintaining the reliability and ease of use of these components. Although the present invention has been described in terms of preferred embodiments, numerous modifications and variations will be apparent to those of skill in the art. For example, although the connector components are illustrated as having flexible fingers mounted in a housing, with a spacer element inserted therein, it will be apparent that the spacer walls can be formed in the housing, with the flexible fingers being mounted on the insertable spacer element. Other variations may be made without departing from the true spirit and scope of the invention as defined in the following claims:

What is claimed is:

1. An electrical socket for use with connectors having plastic retaining fingers, comprising:

a stamped sheet metal body portion having a first crimping region at a rearward end thereof, said crimping region having a first pair of opposed arms precision formed to extend around and to engage the insulating cover of an electrical connector wire to secure the body portion thereto and having a second crimping region spaced from said first crimping region and including a second pair of opposed arms precision formed to extend around and engage bare wire strands of an electrical connector wire to provide electrical contact therewith, said stamped sheet metal body portion further including a forward region having opposed edges, said forward region being precision formed to join said edges to provide a generally cylindrical head having a longitudinal axis, said forward region being shaped to form at the distal end of said head a pair of opposed contact fingers, said fingers being semicircular in cross section and extending slightly inwardly toward each other to provide a spring load grip on a pin terminal inserted therebetween;

a cylindrical hood surrounding only said head and said opposed fingers to protect said fingers and to provide a latching surface for retaining the socket in a connector, said hood being coaxial with said head and engaging said generally cylindrical forward region adjacent said distal end of said contact fingers, having an open forward end folded inwardly to provide a rounded inlet guide for a pin terminal, and having a rearward end portion precision formed to provide an open, outwardly flared, annular shoulder which is coaxial with said head and which has an inner surface which flares outwardly from engagement with said cylindrical head to provide a sharply outwardly angled, rearwardly-facing annular latching edge defining a substantially planar latching surface normal to said longitudinal axis of said head, said edge being adapted to engage a corresponding plastic retaining finger latching surface in a socket-receiving connector; and means securing said hood to said cylindrical head.

2. The socket terminal of claim 1, wherein said securing means comprises crimp means on said hood spaced from said latching edge and engaging said forward region of said cylindrical head rearwardly of said contact fingers for securing said hood to said cylindrical head.

3. The socket terminal of claim 1, wherein said outwardly flared annular shoulder terminates in an outermost cylindrical end wall surface for said hood, said end wall being coaxial with said head and intersecting said flared inner surface to define said annular latching edge.

* * * * *